US005424762A

United States Patent [19]

Higashi et al.

[11] Patent Number: 5,424,762

[45] Date of Patent: Jun. 13, 1995

[54] COLOR PRINTER CAPABLE OF UTILIZING A JOINTED COLOR INK SHEET

[75] Inventors: Kazuhiko Higashi; Kiyoshi Takakuwa; Fumio Kouzai, all of Fukuyama, Japan

[73] Assignee: Mitsubishi Denki Kabushiki Kaisha, Tokyo, Japan

[21] Appl. No.: 31,475

[22] Filed: Mar. 15, 1993

[30] Foreign Application Priority Data

Mar. 17, 1992 [JP] Japan ..... 4-060540

[51] Int. Cl.[6] ..... B41J 17/00; B41J 33/00

[52] U.S. Cl. ..... 347/178; 400/237; 400/224.1; 400/224.2; 400/225; 400/227

[58] Field of Search ..... 346/76 PH; 400/120, 400/223, 224.1, 224.2, 225, 227, 235, 235.1, 236, 236.1, 236.2, 237, 240, 240.3, 240.4

[56] References Cited

U.S. PATENT DOCUMENTS 4,502,057 2/1985 Kawano et al. ..... 346/76 PH
4,893,951 1/1990 Iwatani et al. ..... 400/225

FOREIGN PATENT DOCUMENTS 59-146887 8/1984 Japan .
2-147375 6/1990 Japan .

OTHER PUBLICATIONS

*Patent Abstract of Japan,* vol. 8, No. 267 (M-343) (1704), Dec. 7, 1984, JP-A-59 140 086.
*Patent Abstracts of Japan,* vol. 10 No. 51 (M-457) (2108), Feb. 28, 1986, JP-A-60 199 686.
*Patent Abstracts of Japan,* vol. 15, No. 81 (M-676) (2928), Mar. 15, 1988, JP-62 220 363.

*Primary Examiner*—Huan H. Tran
*Attorney, Agent, or Firm*—Burns, Doane, Swecker & Mathis

[57] ABSTRACT

The provision is made of a firmware (F/W: ROM, RAM) which enables an accurate indexing of an ink sheet so that printing is not performed at the joint portion when an ink sheet having a joint is used. Therefore, an ink sheet having a joint can be used, decreasing running cost of the printer.

5 Claims, 10 Drawing Sheets

COLOR PRINTER CAPABLE OF UTILIZING A JOINTED COLOR INK SHEET

BACKGROUND OF THE INVENTION

This invention relates to a thermo-transfer printer capable of utilizing a jointed color ink sheet or ribbon.

The description will be first made as to a method for manufacturing a conventional ink sheet in conjunction with FIGS. 9 and 10. FIG. 9 is a view illustrating a method for manufacturing a conventional ink sheet and FIG. 10 is a view illustrating a conventional ink sheet.

In FIG. 9, 1 is a jumbo roll, 2 is an ink sheet used in a thermo-transfer printer and 3 is a defect portion.

One roll of ink sheet for use in a thermo-transfer printer is prepared by cutting a roll 1 of ink sheet called a jumbo roll into sections of a predetermined length corresponding to an ink sheet roll. When a defect is found in the sheet section as shown in FIG. 9, one complete section corresponding to one roll of ink sheet is discarded or disposed of and another new section corresponding to one roll is cut from the jumbo roll. FIG. 10 illustrates the ink sheet section corresponding to one roll.

In FIG. 10, it is seen that the ink sheet 2 is attached to bobbins 4 at the opposite ends and yellow ink (Y) is provided with a Y mark 5, magenta ink (M), cyan ink (C) and black ink (BK) are provided with M, C and B marks 6, respectively, and an EOI (End Of Ink) mark 7 is provided at the end of the ink sheet. Reference numeral 8 is a transparent tape.

Then, the operation of a conventional thermo-transfer printer will be described in conjunction with FIGS. 11 and 12. FIG. 11 is a flow chart showing the operation of the conventional thermo-transfer printer. FIG. 12 is a diagram illustrating a relative relationship between the conventional ink marks and an ink mark sensor of the conventional thermo-transfer printer.

In FIG. 11, in a step S1, the ink sheet 2 is first started to be wound and the judgement whether or not it is the Y mark 5 is made in a step S2. In a step S3, the Y mark 5 is searched for until time-out when it is not the Y mark 5. In a step S4, when the time-out is reached without finding the Y mark 5, it is judged to be a jam error. On the other hand, in a step S5, the index of the ink sheet is completed when the Y mark 5 is found.

In FIG. 12, in a step S10, the ink mark sensor searches for the Y mark 5. In a step S11, a mark edge is detected. In a step S12, the judgement is achieved at the center of the mark as to the M, C or BK mark 6. In a step 13, the Y mark 5 is again searched for. In a step S14, the mark edge is detected. In a step S15, the judgement is achieved at the center of the mark as to the Y mark 5 to complete the search.

With the conventional ink sheet, the roll must not be broken or separated. Therefore, when a defect is generated during the manufacturing of a roll, that roll in its entirety is wasted. While the yield of the ink sheet can be increased by removing the sheet portion with a defect and joining a fresh ink sheet to form a complete roll of the ink sheet, the ink sheet cannot be precisely joined together at the sheet portion where the ink mark changes because of the simplicity of the sheet joining operation. Therefore, the ink sheet must be joined by an adhesive tape.

However, the conventional thermo-transfer printer cannot use a color ink sheet with a joint. Accordingly, it is desirable to provide a color printer in which a color ink ribbon with a joint can be used.

SUMMARY OF THE INVENTION

This invention has been made in order to solve the above-discussed problems and has as its object the provision of a printer in which a color ink ribbon with a joint can be used.

Another object of the present invention is to provide a thermo-transfer color printer which can use a color ink ribbon with a joint.

The thermo-transfer printer of the present invention is provided with the following means:

(1) an ink mark sensor for detecting ink marks on an ink sheet on which a set of colors is applied in the order of yellow, magenta, cyan and black and which has ink marks corresponding to each of said colors; and (2) ink sheet feed control means for controlling, when a joint of said ink sheet is detected on the basis of said detected ink mark, the feed of said ink sheet to index the first yellow after said detected joint.

In the present invention, the ink mark sensor detects ink marks on an ink sheet on which a set of colors is applied in the order of yellow, magenta, cyan and-black and which has ink marks corresponding to each of said colors.

Also, the ink sheet feed control means controls the feed of said ink sheet, when a joint of said ink sheet is detected on the basis of said detected ink mark, to index the first yellow after said detected joint.

BRIEF DESCRIPTION OF THE DRAWINGS

The present invention will become more readily apparent from the following detailed description of the preferred embodiments of the present invention taken in conjunction with the accompanying drawings in which.

DESCRIPTION OF THE PREFERRED EMBODIMENT

Figure 1A:
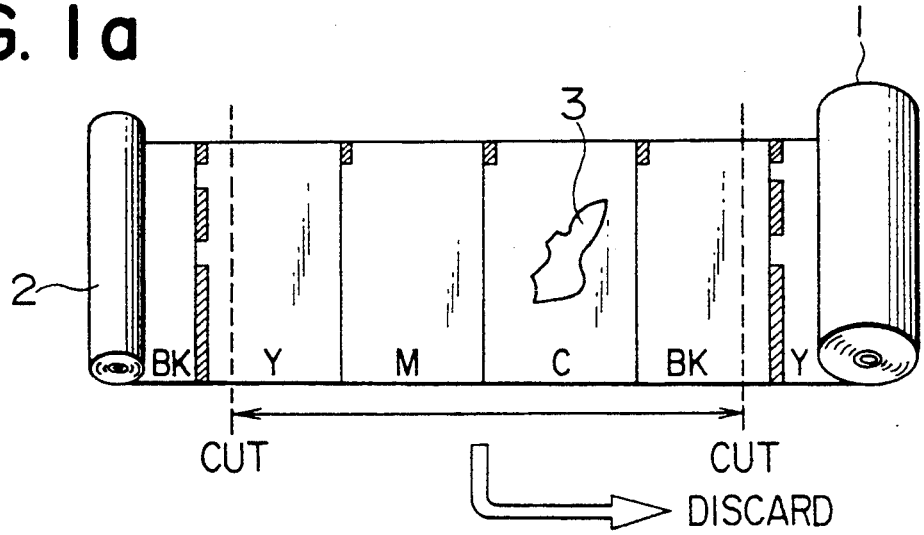
FIGS. 1*a* to 1*c* are views showing the manufacturing method of an ink sheet suitable for use with an embodiment of the color printer of the present invention.
Figure 1B:
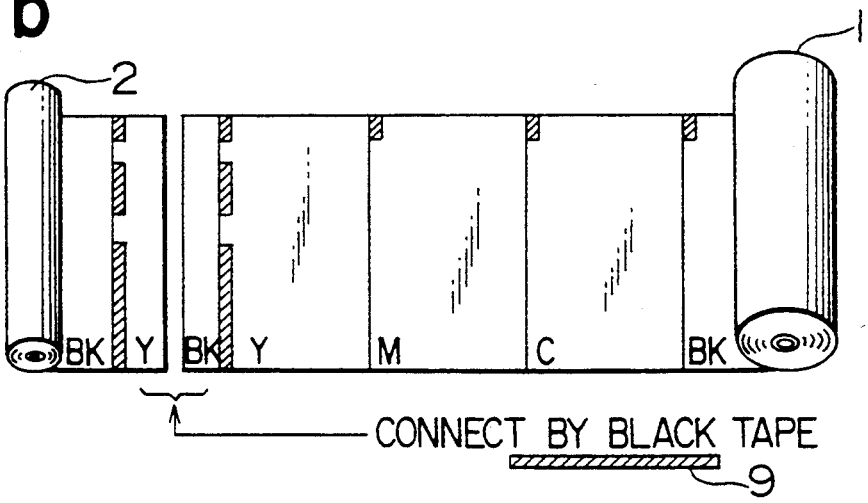
Figure 1C:
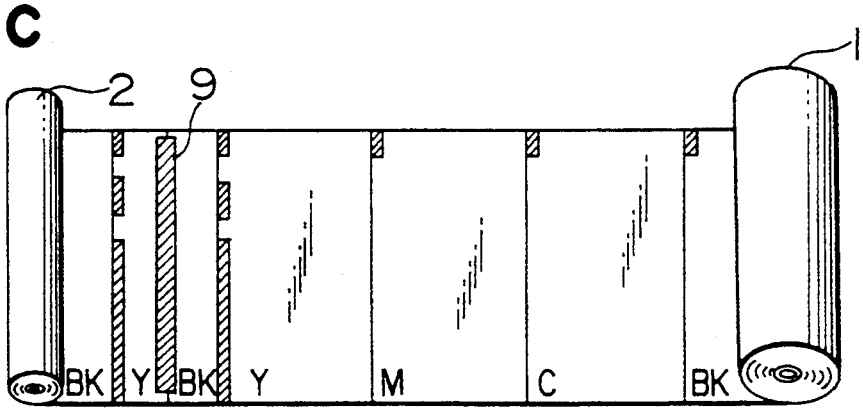

At first, a method for manufacturing an ink sheet or ink ribbon suitable for use with a color printer of the embodiment of the present invention will be described with reference to FIGS. 1*a–c* is a view illustrating the method for manufacturing the ink sheet suitable for use with the present invention.

The ink sheet or ink ribbon corresponding to one roll suitable for use with the color printer of the present invention is prepared by cutting from the jumbo roll 1. However, when there is the defect portion 3 in an intermediate portion of the sheet section, a particular section of the ink sheet having one set of colors including the defective portion is removed and disposed of. Then, as shown in FIGS. 1(*b*) and 1(*c*), one portion of the yellow ink section and one portion of the black ink section are connected together by a light-interrupting black adhesive tape 9 to form an ink sheet 2 corresponding to one roll. When no defect portion 3 is presented in the intermediate portion, the method is identical to the conventional method for manufacturing an ink sheet.

Figure 2:
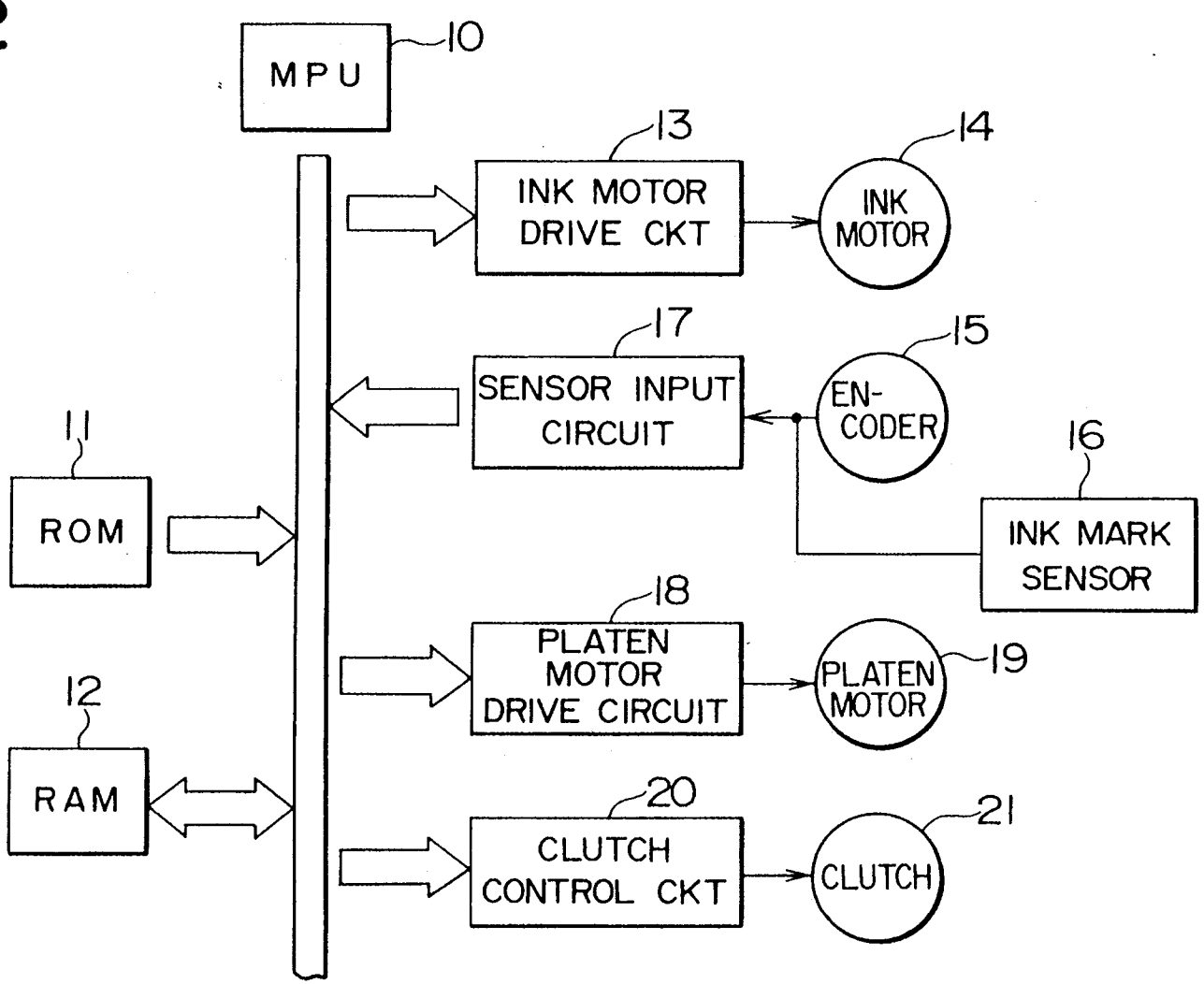
FIG. 2 is a block diagram illustrating the color printer of the present invention.
Figure 3:
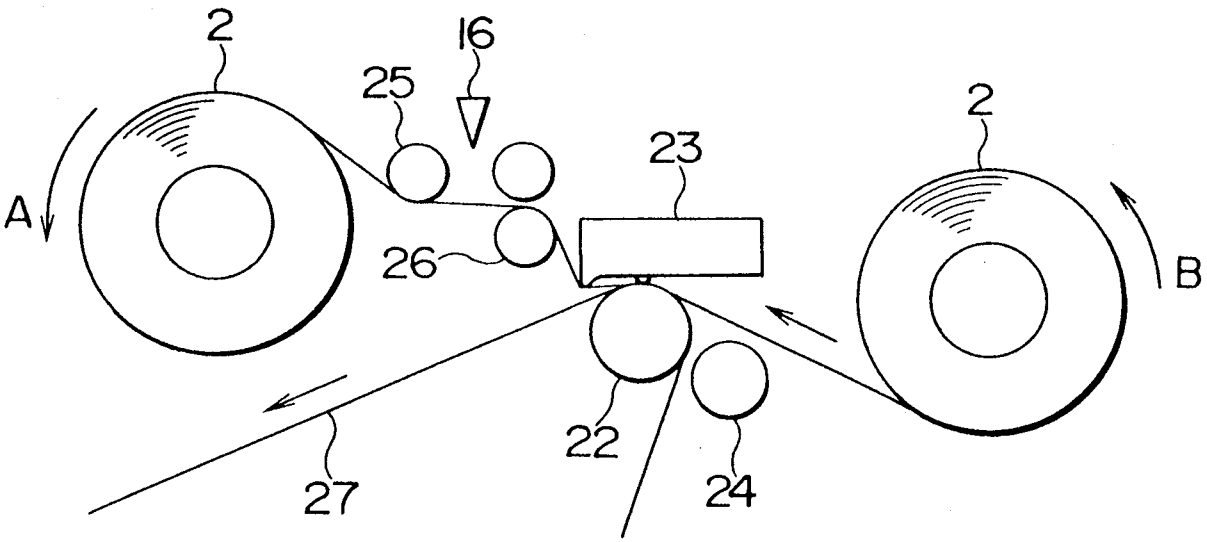
FIG. 3 is a side view of the color printer of the present invention.

The construction of a color printer of the embodiment of the present invention will now be described in conjunction with FIGS. 2 and 3. FIG. 2 is a block diagram illustrating a color printer of the present invention and FIG. 3 is a schematic side view illustrating the color printer of the present invention. Throughout the figures, the same reference numerals designate identical or corresponding components.

In FIG. 2, reference numeral 10 is an MPU for managing the control of the entire apparatus, 11 is a ROM connected to the MPU 10 through a bus, 12 is a similarly connected RAM, 13 is an ink motor drive circuit, 14 is an ink motor connected to the ink motor drive circuit 13 for taking up and feeding the ink sheet 2, 15 is an encoder for counting pulses corresponding to the feed amount of the ink sheet 2, 16 is an ink mark sensor including, for example, five optical sensors arranged widthwise from an end portion of the ink sheet 2, 17 is a sensor input circuit connected to the encoder 15 and the ink mark sensor 16, 18 is a platen motor drive circuit, 19 is a platen motor connected to the platen motor drive circuit 18, 20 is a clutch control circuit and 21 is a clutch connected to the clutch control circuit 20.

In FIG. 3, reference numeral 22 is a platen driven by the platen motor 19, 23 is a thermal head, 24 is a pinch roller, 25 and 26 are feed rollers and 27 is a print paper.

It is to be noted that in the present invention the ink sheet feed control means in the first embodiment is composed of the MPU 10, the ROM 11, the RAM 12, the ink motor drive circuit 13, the ink motor 14, the encoder 15, the sensor input circuit 17, etc.

Figure 4:
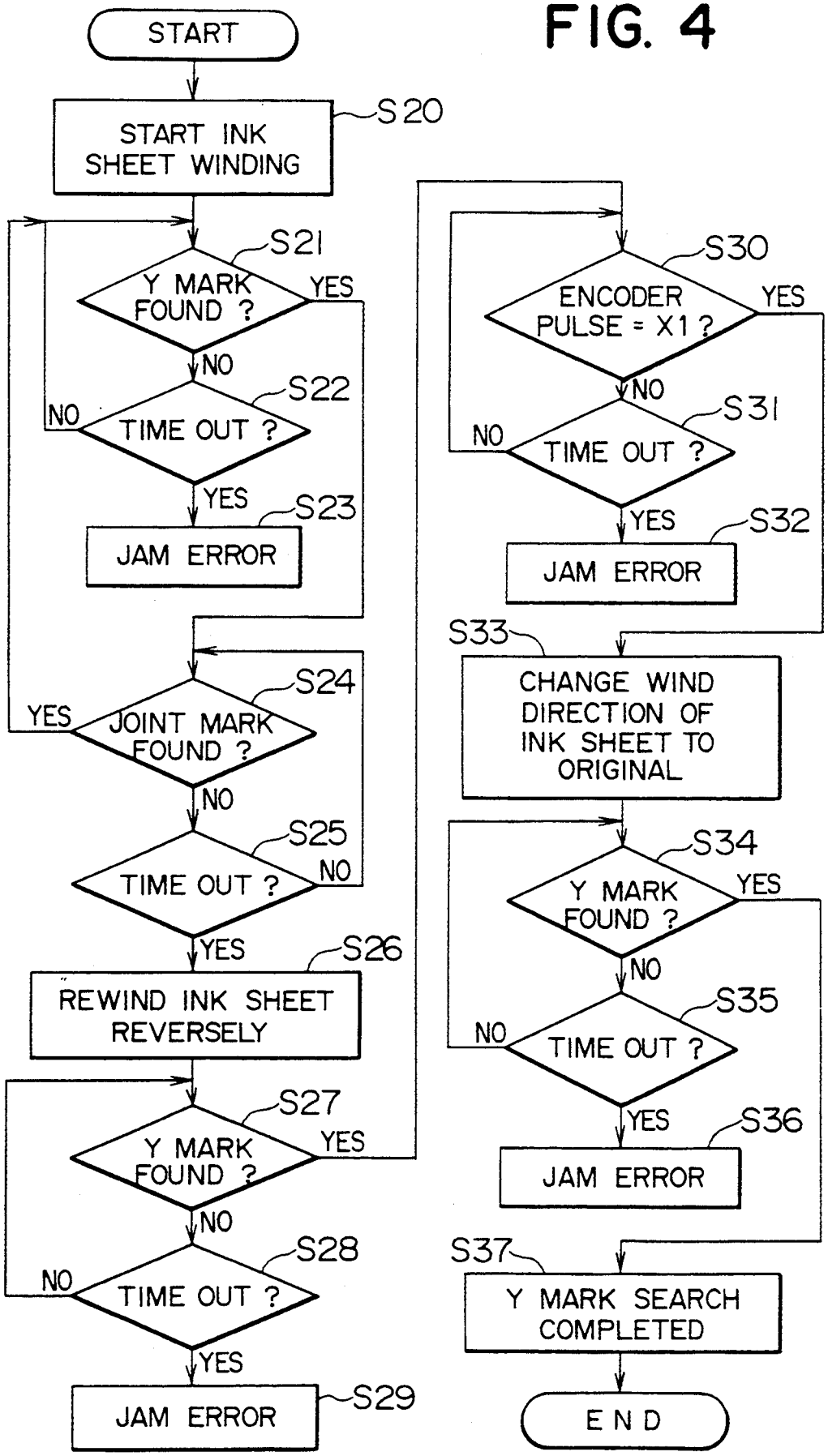
FIG. 4 is a flow chart showing the operation of the color printer of the present invention.
Figure 5:
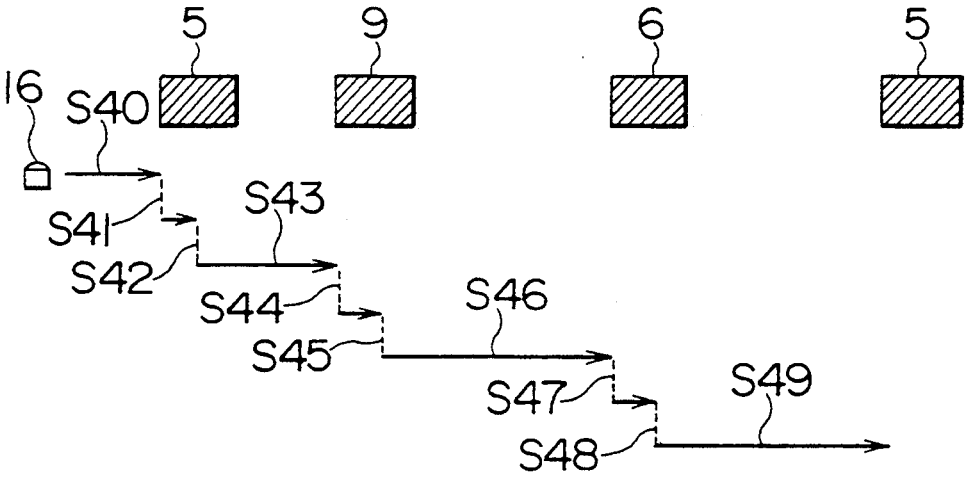
FIG. 5 is a diagram showing the relative relationship between the ink mark and the ink mark sensor of the color printer of the embodiment of the present invention.
Figure 6:
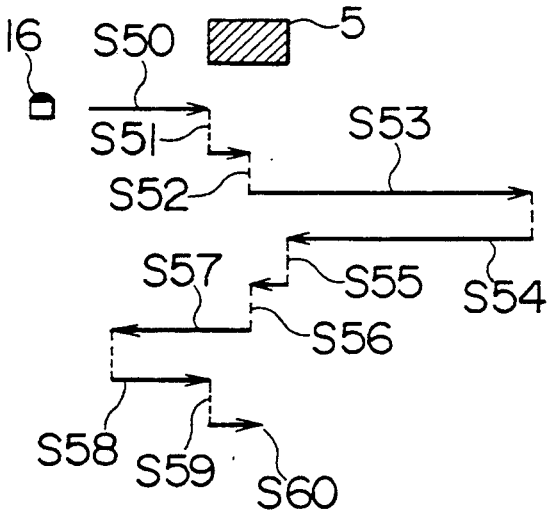
FIG. 6 is a diagram showing the relative relationship between the ink mark and the ink mark sensor of the color printer of the embodiment of the present invention.
Figure 7:
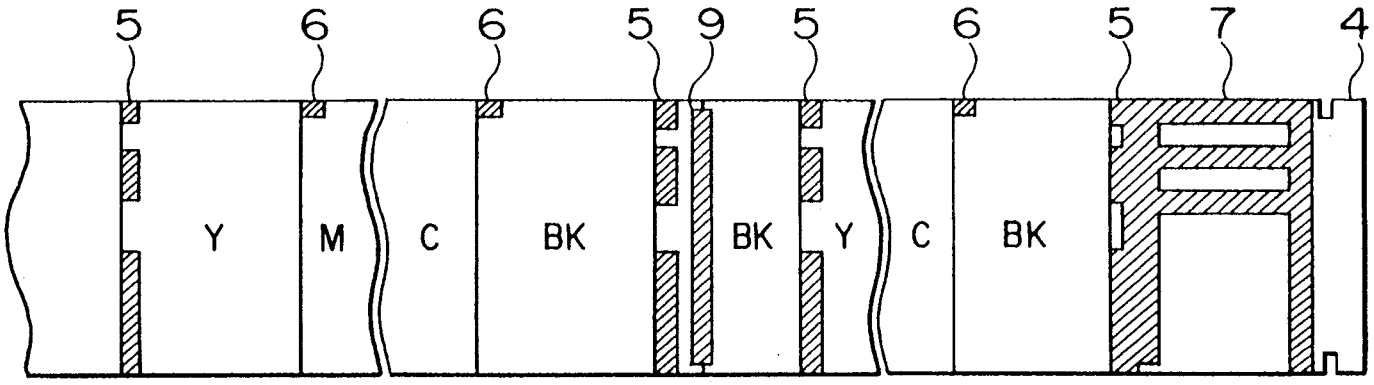
FIG. 7 is a view illustrating an ink sheet suitable for use in the color printer of the present invention.
Figure 8:
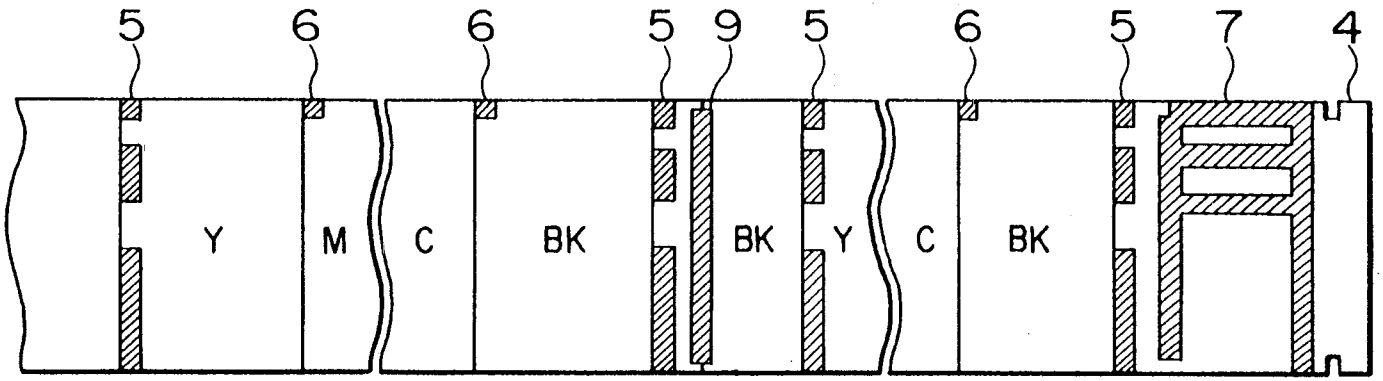
FIG. 8 is a view illustrating an ink sheet suitable for use in the color printer of the present invention.
Figure 9:
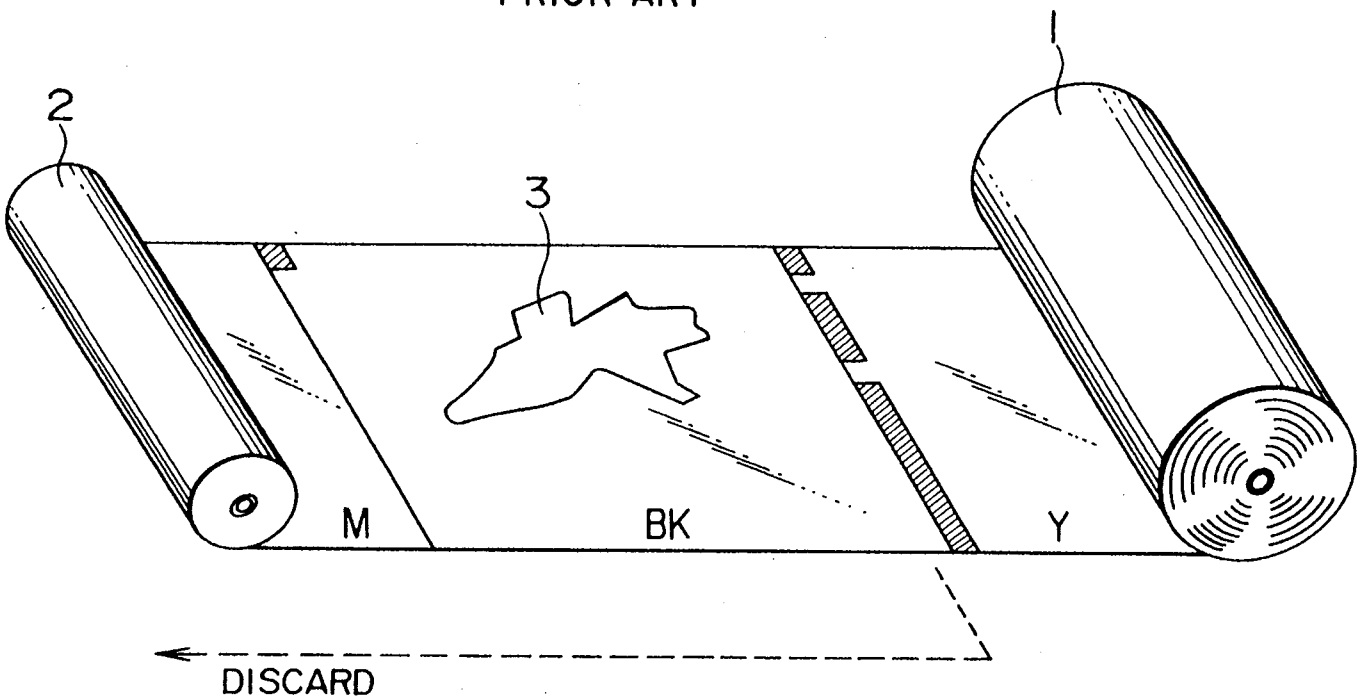
FIG. 9 PRIOR ART
FIG. 9 is a perspective view of the ink sheet illustrating the method of manufacturing the ink sheet used in a conventional thermo-transfer printer.
Figure 10:
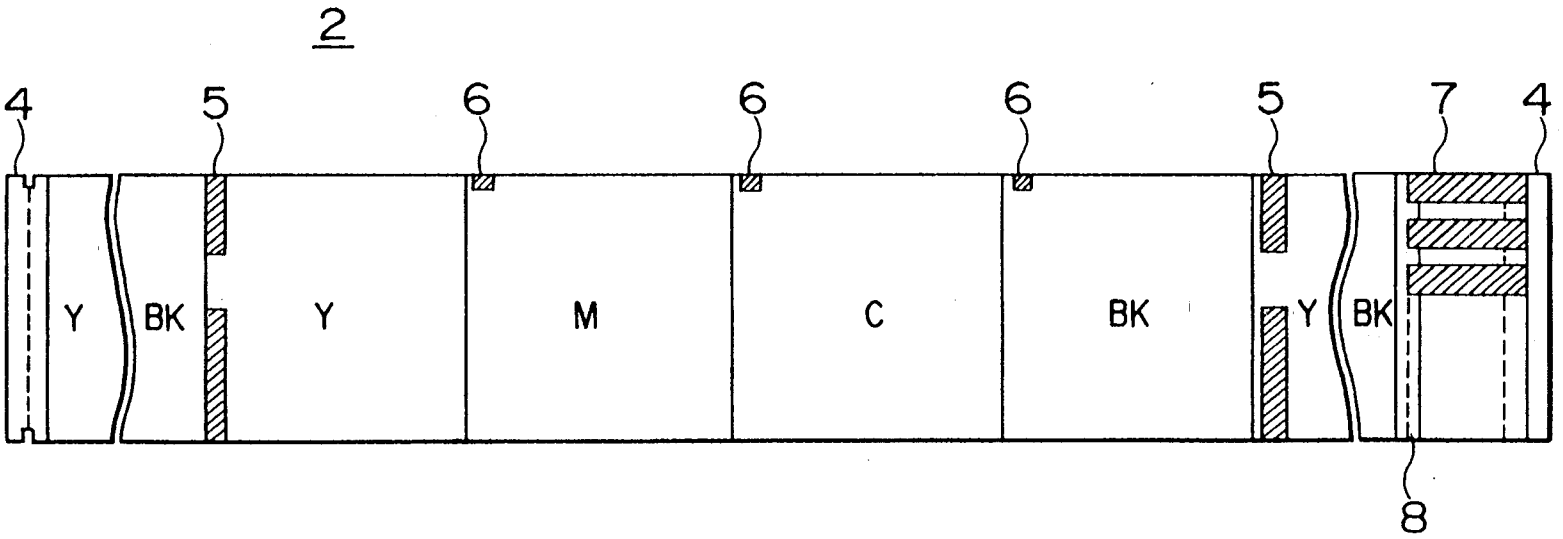
FIG. 10 PRIOR ART
FIG. 10 is a view illustrating the ink sheet used in the conventional thermo-transfer printer and in the color printer of the present invention.
Figure 11:
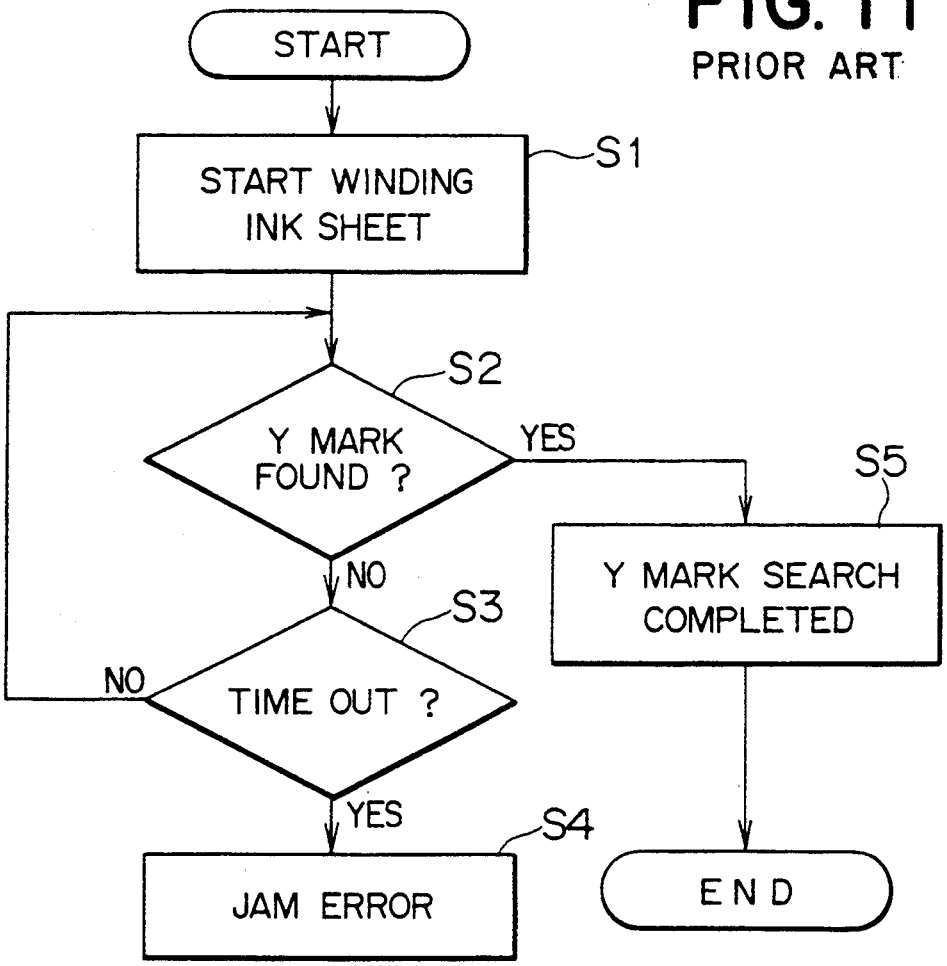
FIG. 11 PRIOR ART
FIG. 11 is a flow chart showing the operation of the conventional thermo-transfer printer.
Figure 12:
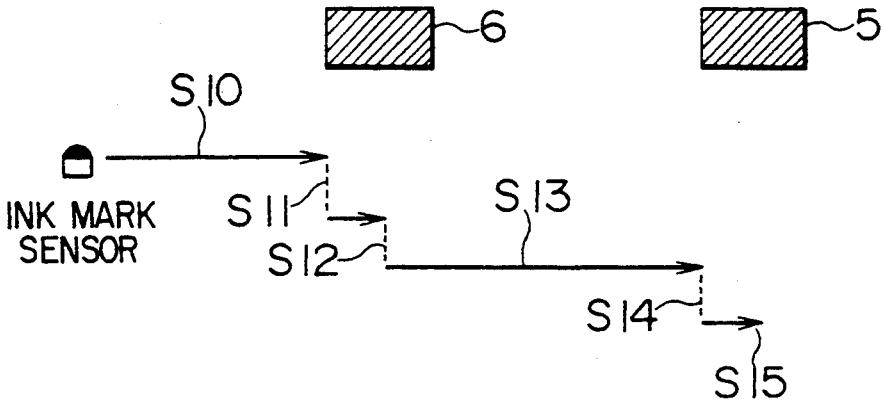
FIG. 12 PRIOR ART
FIG. 12 is a diagram showing the relative relationship between the ink mark and the ink mark sensor of the conventional thermo-transfer printer.

Next, the operation of the above-described color printer will be described with reference to FIGS. 4 to 8. FIG. 4 is a flow chart illustrating the operation of the color printer of the present invention. FIGS. 5 and 6 are diagrams illustrating the relative relationship between the ink mark and the ink mark sensor. FIGS. 7 and 8 are views illustrating the jointed ink sheet which is suitable for use in the color printer of the present invention.

In FIG. 4, in a step S20, the MPU 10 starts winding up the ink sheet 2 by means of the ink motor drive circuit 13 and the ink motor 14.

In steps S21~S23, the ink mark sensor 16 searches for the Y mark 5 for a predetermined period of time (time out: corresponding to the time interval between the Y marks) and, when no Y mark is found within the predetermined time period, it is processed as a jam error (for example, a warning lamp on an operation panel is lit). When found, the process proceeds to a step S24.

In step S24~S26, the joint mark 9 is searched for a predetermined time period and when it is not found the ink sheet 2 is taken up in the reverse direction. When the mark is found, the process returns to the step S21 to search the next Y mark.

In step S27~S29, the original Y mark 5 is searched for a predetermined time period and, when it is not found within the predetermined time period, it is processed as a jam error. When the mark is found, the process proceeds to a step S30.

In steps S30~S33, it is determined whether or not the ink sheet 2 has been rewound by a predetermined amount (X1) and, when the rewinding has not been completed within the predetermined time, it is processed as a jam error. When the predetermined amount could be rewound the direction of winding is changed to return to its original direction.

In step S34~S37, the Y mark 5 is searched for a predetermined time period and, when not found within the predetermined time period, it is processed as a jam error. When found, the search for the Y mark is completed in a step S37.

The searching operation of the joined sections will now be described with reference to FIG. 5. In a step S40, the ink mark sensor 16 searches for the Y mark 5. In a step S41, a mark edge is detected. In a step S42, the determination is made at the center of the mark that it is the Y mark 5. In a step S43, the joint mark 9 is searched for. In a step S44, the mark edge is detected. In a step S45, the determination is made at the center of the mark that it is the joint mark 9. In a step S46~S49, the next Y mark 5 is searched for.

The operation for searching the joint-less portion will now be described in conjunction with FIG. 6. In a step S50, the ink mark sensor 16 searches for the Y mark 5. In a step S51, the mark edge is detected. In a step S52, the determination is made at the center of the mark that it is the Y mark 5. In a step S53, the joint mark 9 is searched for. When the joint mark 9 is not found within the time-out range, i.e., within the predetermined section length, the ink sheet 2 is rewound in the reverse direction in a step S54 and the Y mark 5 is searched for.

In a step S55, the mark edge is detected. In a step S56, the determination is made at the center of the mark that it is the Y mark 5. In a step S57, the pulses at the encoder 15 are counted and the ink sheet 2 is rewound by a predetermined length. In a step S58, the direction of taking up the ink sheet 2 is returned to its original direction to search for the Y mark 5. In a step S59, the mark edge is detected. In a step S60, the determination is made that it is the Y mark 5, whereby the index of the Y mark 5 is completed.

The ink sheets 2 with the joint illustrated in FIGS. 7 and 8 are examples of the sheets in which the portion between the EOI mark 7 and the Y mark 5 is filled with a black tape or the like and in which the portion is not filled with the black tape. The ink mark sensor 16, in one example, is composed of five optical sensors arranged from the upper end in FIG. 7. Therefore, the output from the ink mark sensor is expressed, in binary code, "10110" for the Y mark 5, "10000" for the M, C and BK marks, "11111" for the joint mark 9 and "10101" for the EOI mark. The binary code in which "1" and "0" is interchanged can be similarly used.

In the color printer of the present invention, as previously described, a firmwear (F/W: ROM, RAM) enabling accurate indexing of the ink sheet 2 so that the printing is not performed at the joint portion when the ink sheet 2 having a joint is employed, and so that an ink sheet with a joint can be used, thereby advantageously decreasing the running cost.

In manufacturing the ink sheet suitable for the color printer of the present invention, the joint portion of the ink sheet 2 is connected by means of black tape to facilitate the manufacture, thereby improving the yield of the ink sheet 2.

As has been described, the thermo-transfer printer of the present invention is provided with an ink mark sensor for detecting ink marks on an ink sheet on which a set of colors is applied in the order of yellow, magenta, cyan and black and which has ink marks corresponding to each of said colors, and ink sheet feed control means for controlling the feed of said ink sheet, when a joint of said ink sheet is detected on the basis of said detected ink mark, to index the first yellow after said detected joint, so that an ink sheet having a joint can be employed and the running cost can be advantageously decreased.

What is claimed is:

1. Apparatus for use in a thermo-transfer color printer, said apparatus comprising:

means for feeding an ink sheet; and an ink mark sensor for detecting ink marks on said ink sheet on which a set of colors is applied in an order of yellow, magenta, cyan, and black, said ink marks corresponding respectively to each of said colors and a joint on the ink sheet, and for generating a signal to control said means for feeding the ink sheet, when a joint of said ink sheet is detected on the basis of said ink marks, to index to a first yellow after said joint.

2. Apparatus for use in a thermo-transfer color printer as claimed in claim 1, wherein said means for feeding the ink sheet comprises a bus, an MPU connected to said bus, a ROM connected to said bus, a RAM connected to said bus, an ink motor drive circuit connected to said bus, an ink motor connected to said ink motor drive circuit, an encoder, and a sensor input circuit connected respectively to the bus, the encoder, and the ink mark sensor.

3. Apparatus for use in a color printer, said apparatus comprising:

means for feeding an ink ribbon; and an ink mark sensor for detecting ink marks on said ink ribbon, said ink marks corresponding respectively to ink colors in a set of ink colors and a joint on the ink ribbon, and for generating a signal to control said means for feeding the ink ribbon, when a joint of said ink ribbon is detected on the basis of said ink marks, to index to a first color of said set of ink colors after said joint.

4. Apparatus for use in a color printer as claimed in claim 3, wherein said means for feeding the ink ribbon comprises: a communications bus, a central processing unit connected to said communications bus, an ink motor drive circuit connected to said communications bus, an ink motor connected to the ink motor drive circuit for taking up and feeding the ink ribbon, an encoder for counting pulses corresponding to said taking up and feeding of the ink ribbon, and a sensor input circuit connected respectively to the communications bus, the encoder, and the ink mark sensor.

5. Apparatus for use in a color printer as claimed in claim 3, wherein said means for feeding the ink ribbon comprises a bus, an MPU connected to said bus, a ROM connected to said bus, a RAM connected to said bus, an ink motor drive circuit connected to said bus, an ink motor connected to said ink motor drive circuit, an encoder, and a sensor input circuit connected respectively to the bus, the encoder, and the ink mark sensor.

* * * * *